United States Patent [19]

Baseggio et al.

[11] Patent Number: 4,757,697

[45] Date of Patent: Jul. 19, 1988

[54] MACHINE A TRICOTER

[75] Inventors: Marcello Baseggio, Ollon; Michel Berger, Choex, both of Switzerland

[73] Assignee: Atelier de Construction Steiger S.A., Vionnaz, Switzerland

[21] Appl. No.: 52,450

[22] Filed: May 20, 1987

[30] Foreign Application Priority Data

May 22, 1986 [EP] European Pat. Off. ..... 86200886.9

[51] Int. Cl.[4] ..... D04B 15/52

[52] U.S. Cl. ..... 66/128

[58] Field of Search ..... 66/126, 127, 128, 129

[56] References Cited

U.S. PATENT DOCUMENTS 4,052,865 10/1977 Zamarco ..... 66/127

4,179,906 12/1979 Patthey ..... 66/128

FOREIGN PATENT DOCUMENTS 2064599 6/1981 United Kingdom ..... 66/128

*Primary Examiner*—Ronald Feldbaum

*Attorney, Agent, or Firm*—Kane, Dalsimer, Sullivan, Kurucz, Levy, Eisele and Richard

[57] ABSTRACT

The machine comprises a knitting head (2), a camholder carriage (3) and several striping bars (7), on which thread guides (6, 6*a*) are mounted between two movable stop blocks (9, 9*a*) and are equipped with a thread catcher (21, 21*a*) and driven by fingers (25, 25*a*). Auxiliary drive means (11) for the stop blocks and a mechanism for attaching the thread guides automatically to the stop blocks, detachable by means of the drive finger (25), make it possible at any moment to shift the thread guides together with one of these stop blocks independently of the movement of the carriage, thus making it possible to move away the thread catcher when it stops knitting, in the production of INTARSIA knitted fabrics.

3 Claims, 3 Drawing Sheets

MACHINE A TRICOTER

The subject of the present invention is a flat-bed knitting machine comprising at least one knitting head, at least one camholder carriage traveling above the knitting head in order to drive the needles, several striping bars which are parallel to the knitting head and on each of which a thread guide is mounted slideably between two stop blocks likewise movable along the striping bar, the thread guide equipped with a thread catcher being driven by fingers fixed to the carriage and mounted elastically so that they can be moved away from the thread guides by means of slopes of the stop blocks, a mechanism for attaching the thread guides automatically to the stop blocks, individual auxiliary drive means for the stop blocks, and control means intended for these drive means and subject to the control means of the knitting machine.

It is necessary for the thread catchers of the thread guides to move in a different direction from that of the carriage when Intarsia knits are produced, more specifically when the thread is changed during the transfer from one color to another color. The thread catcher which stops knitting has to be moved away to leave room for the needle which rises in order to pick up the new thread.

Several mechanisms have already been provided to ensure that the thread catcher can move away. The mechanism descirbed in No. DE-A-2,555,750 comprises a thread catcher mounted pivotably on the block of the thread guide by means of a system of levers and joint, the thread guide being equipped with two pushers which control the retraction of the thread catcher when it encounters one of the stop blocks. It is therefore possible for the thread catcher to retract only when the thread guide encounters a stop block, and this occurs before the thread guide has stopped.

In another mechanism (No. DE-A-3,245,233), the thread catcher is lifted by a cam carried by the thread guide, the latter being composed of several pieces movable relative to one another, the lifting of the thread catcher being caused as a result of the relative movement of the various elements of the thread guide when the latter meets a stop block. The construction of the thread guide is relatively complicated and, as in the preceding mechanism, the thread catcher can move away only at a specific moment, when the thread guide meets a stop block.

In another known mechanism (No. DE-A-2,459,690), the thread catcher can likewise move away vertically and is pulled upwards on the thread guide by two springs, and a piece movable transversely on the thread guide controls the retraction of the thread guide by means of a cam at the moment when it meets a stop block, that is to say just before the thread guide stops.

A feature common to all the known systems is a more or less complicated mechanism which is mounted on the thread guide and which ensures that the thread catcher moves away at the moment when the thread guide meets a stop block and at that moment only, the thread catcher being mounted movably on the thread guide. The sole function of the stop blocks is that of a stopping means. In these known devices, the thread guides can impede one another if they are very close to one another, particularly with regard to rocking thread catchers which risk hooking up an adjacent thread catcher or thread and causing an accident.

It has also been proposed to move a thread guide by means of the stop block to which the thread guide is attached automatically (No. FR-A-2,384,048). However, the movement of the stop block takes place only when there is a reversal in the running direction of the carriage, that is to say between the knitting of two successive rows. This mechanism, if used for the knitting of an Intarsia knit, would demand a high positioning accuracy of the thread guides, to ensure that the needles located on either side of the thread guide do not touch one another during the color change.

The object of the present invention is to allow the thread catchers to travel independently of the movement of the carriage at any moment, that is to say not only when the thread guide meets a stop block. The invention also aims to achieve this object by as simple means as possible.

This object is achieved by the means defined in claim 1.

In the system according to the invention, the stop blocks are not used as stopping means, but as drive means for the thread guides, and the means of positioning the stop blocks are used at the same time for moving away or retracting the thread guides. Since the stop blocks are driven by auxiliary means, it is possible to shift the thread guides together with their thread catchers at any moment independently of the movement of the carriage.

The mechanism for attaching the thread guides automatically to the stop blocks can be produced very simply on the model of automatic railroad waggon coupling hooks. Detachment can be carried out very simply by means of the thread-guide drive finger which lifts the hook before encountering the driving nose of the thread guide.

The system according to the invention is therefore not only much more flexible than previous systems in terms of its use, but can be produced by means of a mechanism of extreme simplicity.

The accompanying drawing illustrates an embodiment of the invention by way of example.

Figure 1:
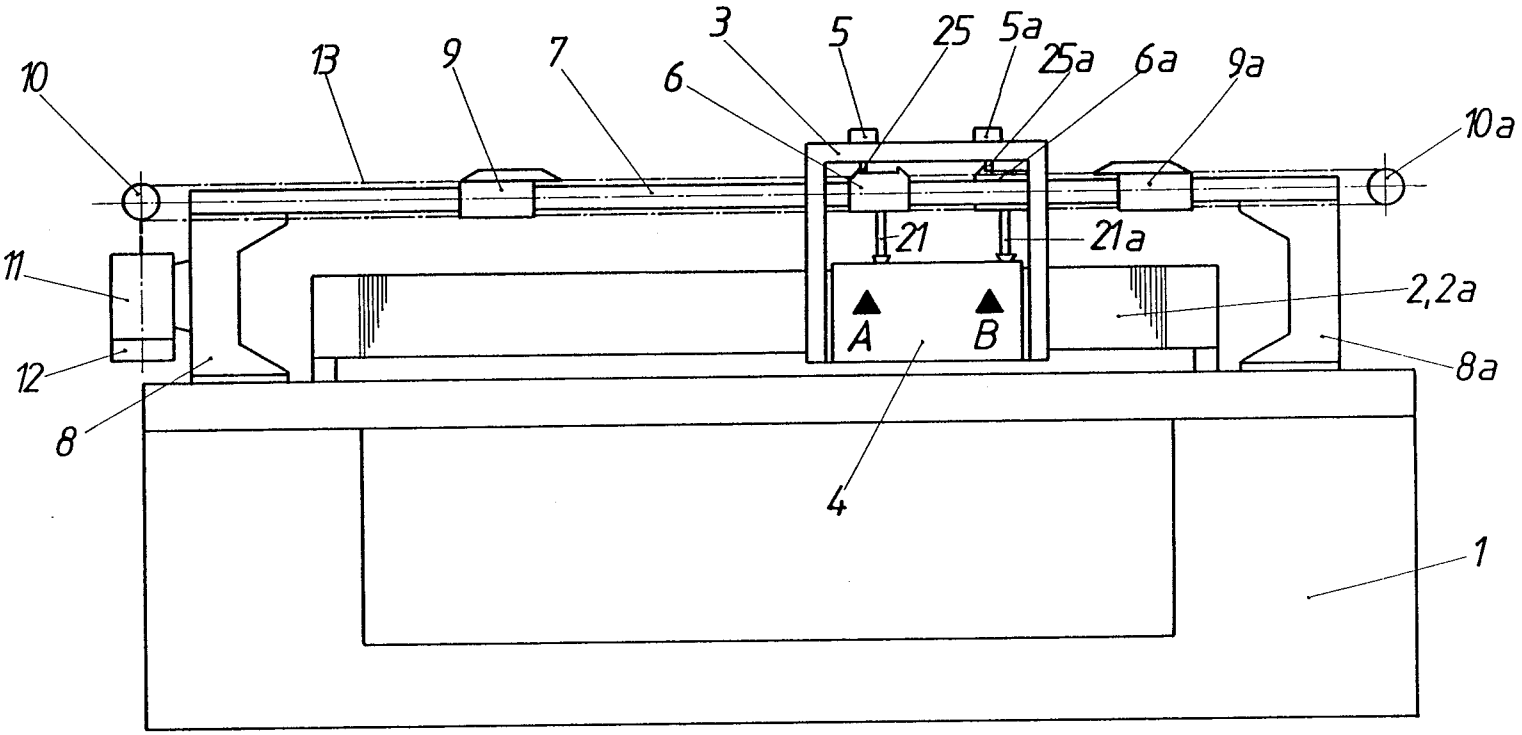
FIG. 1 is a diagrammatic view of the knitting machine according to the invention.

FIG. 1 shows diagrammatically a flat-bed knitting machine comprising a frame 1 supporting two knitting heads 2, 2*a* which are arranged in a V formation and in which are located the needles and their keys, and a carriage 3, to which are fastened camholders 4 of the double-drop type in the example under consideration, each of these drops being symbolized by a triangle A and B respectively. The carriage 3 also carries striping boxes 5 and 5*a* corresponding respectively to the drops A and B and equipped with drive fingers 25 and 25*a* respectively, mounted slideably and elastically in a vertical direction in a knonw way and intended for driving thread guides, such as 6 and 6*a*, mounted on striping bars 7 arranged parallel to one another in a known way and supported by supports 8 and 8*a*. Mounted on each of the striping bars 7 is a pair of stop blocks 9, 9*a* sliding in a known way. The movement of the stop blocks 9 and 9*a* along the striping bars is ensured by means of a motor 11 for each of the pairs of stop blocks. This motor 11 drives a cable 13 extending along the corresponding striping bar 7 and passing over two end pulleys 10 and 10*a*, one of the strands of the cable 13 being fastened to one of the stop blocks 9 and the other strand to the other stop block 9*a*. The motor 11 is controlled by means of a displacement sensor 12 linked directly to the system for reading the position of the carriage 3, that is to say of the thread guides, the assembly as a whole being controlled by a microprocessor which likewise controls the selection of the needles and in which the knitting program is recorded. The selection of the needles is carried out, for example, in the way described in the patent No. CH-A-632,024. Each of the thread guides 6, 6*a* is equipped with a thread catcher 21 and 21*a* respectively, intended for guiding the thread 20 unwound from a fixed bobbin towards the needles.

Figure 2:
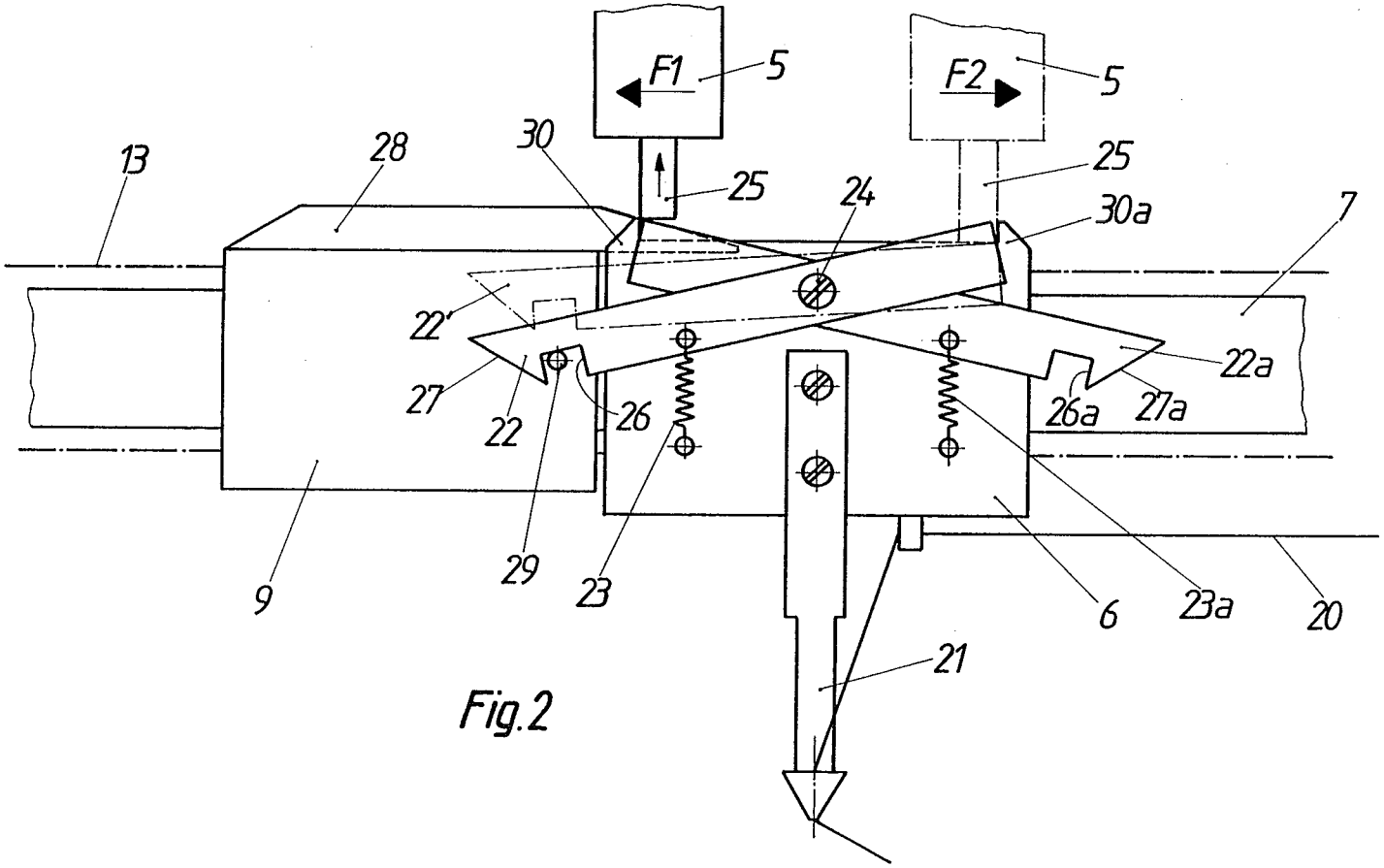
FIG. 2 shows a thread guide and the means of attaching it automatically to the stop block.

As can be seen in FIG. 2, the thread catcher 21 is simply fastened to the thread guide 6 by means of two screws. The thred guide 6 is equipped with two pawls 22 and 22*a* pivoted at the center of the thread guide about a pivot pin 24. Each of these pawls is subjected to the action of a tension spring 23 and 23*a* respectively, tending to keep the pawls in an oblique position, as illustrated in the drawing, up against a stop (not shown). These pawls 22 and 22*a* project on either side of the block 6 of the thread guide, and the projecting ends are in the form of hooks 26 and 26*a* respectively and terminate in a slope 27 and 27*a* respectively, like certain automatic railroad waggon coupling hooks. This hook interacts with a peg 29 integral with the cam block. When the hook is in the attached position or low position, the opposite ends of the pawls 22 and 22*a* are located approximately at the same height as the driving noses 30 and 30*a* of the thread guide 6 which are intended to be driven by the drive finger 25.

When, for example, the thread guide 6 is driven to the left in the direction of the arrow F1 by the drive finger 25, the slope 27 of the pawl 22 encounters the peg 29, and the hook 26 attaches itself to this peg. At the same time, the finger 25 is lifted by one of the slopes of the cam 28 of the stop block 9 and releases the thread guide 6. The thread guide 6, attached to the stop block 9, can then be moved as desired, together with the stop block, by acting on the cable 13.

When the thread guide 6 is to be driven to the right in the direction of the arrow F2 by the drive finger 25, this finger first encounters the pawl 22, the effect of which is to tilt it into the position 22', represented by dot-and-dash lines, thus releasing it from the stop block 9, before it meets the driving nose 30*a* of the thread guide. It will be seen that, although the thread guide 6 has movable pieces, namely the pawls 22 and 22*a*, actuated when the thread guide comes near to a stop block, nevertheless these movable pieces do not act on the thread catcher. It can be seen that the necessary mechanism is extremely simple, robust and highly reliable.

For the sake of simplification, FIG. 1 shows only a single carriage and only two thread guides and two stop blocks, but is is clear that the machine could have several carriages, several striping bars and a larger number of thread guides and corresponding stop blocks.

Instead of the cable 13, it would also be possible to use a chain or an endless screw or any other means of driving the stop blocks. As regards the automatic attachment mechanism, this could be produced in another form, but the embodiment illustrated seems to be the simplest.

Figure 3:
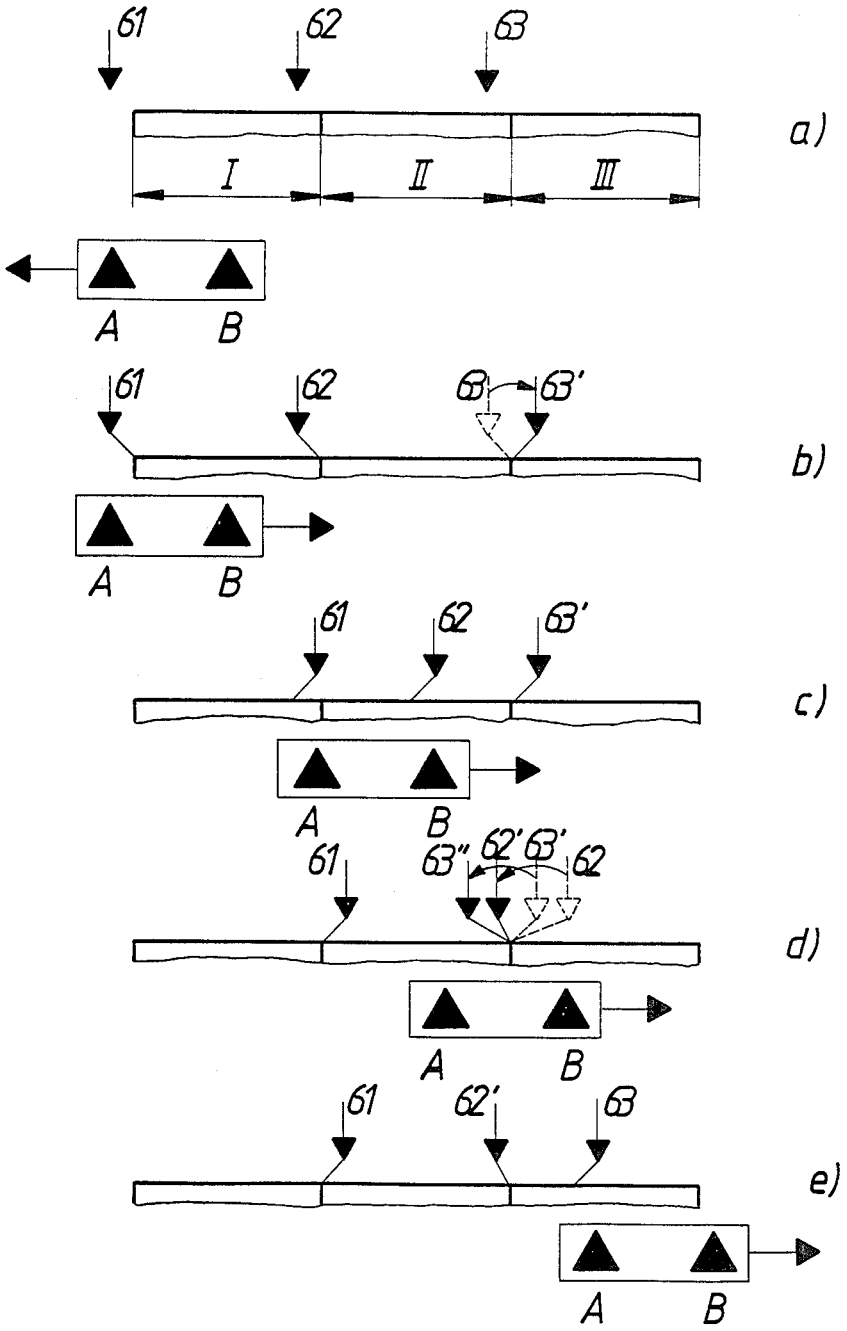
FIG. 3 shows the diagram representing the knitting of an Intarsia knit in three colors.

FIG. 3 shows diagrammatically the movement of three thread guides 61, 62, and 63 of a machine having at least three thread guides, for Intarsia knitting with three knitted zones of different colors I, II and III. The machine is equipped with a double-drop camholder A and B. FIG. 3*a* shows a camholder which moves to the left and which has gone past the knitted piece. The three thread guides 61, 62, and 63 have arrived at the end of their travel, and all three are attached to the corresponding left-hand stop blocks.

FIG. 3*b* shows the camholder A, B returning to the right for the knitting of the next row of stitches. Before the carriage starts to move to the right or at the same time as this movement, the thread guide 63 is moved to the right by means of the left-hand stop block, in order to assume the position 63' so as to free the knitted part II which will be knitted by means of the thread guide 62.

The part I is knitted with the drop A and the thread guide 61, and the part II is knitted with the drop B and the thread guide 62, as shown in FIG. 3*c*.

At the end of the knitting of the part I, the thread guide 61 meets its right-hand stop block, to which it attaches itself, as shown in FIG. 3*d*.

At the end of the knitting of the part II by means of the drop B, the thread guide 62 stops and attaches itself to its right-hand stop block in the position represented by broken lines in FIG. 3*d*. As soon as the thread guide 62 has reached this position, it is returned to the rear, that is to say towards the left into the position 62' by means of the stop block, to which it is attached, in order to free the part III which is still to be knitted. At the same time, the thread guide 63 is likewise moved to the left from the position 63' to the position 63'' by its left-hand stop block, to which it is attached, in a position corresponding to the position shown in FIG. 2, in order to prepare for knitting the part III. The movement of the thread guides 62 and 63 shown in FIG. 3*d* must take place as soon as the drop B has finished working and, above all, before the drop A starts to actuate the needles of the knitted part III.

FIG. 3*e* shows the thread guide 63 moving to the right during the knitting of the part III by means of the drop A.

Once the knitting of the part III has ended, the thread guide 62 is moved to the right by means of its right-hand stop block, in such a way that the three thread guides are in a similar position on the right of the end of the corresponding knitted part. The carriage 3 subsequently moves from right to left, and it is then the thread guide 61 which is moved to the left in order to free the part II of the knitted fabric, the parts II and III being knitted subsequently by means of the drops A and B respectively. At the end of the knitting of the part II, the thread guides 61 and 62 are moved away to the right to allow the part I to be knitted by means of the drop B, and so on and so forth.

The time available for moving two adjacent thread catchers simultaneously, as in FIG. 3*d*, is equal to the time taken by the carriage to cover a distance equal to the distance separating the centers of the two drops A and B.

It is immediately possible to apply the knitting principle illustrated in FIG. 3 to knitting by means of four, five or more thread guides.

We claim:

1. A flat-bed knitting machine comprising at least one knitting head (2) including knitting needles, at least one camholder carriage (3) having several knitting systems traveling above the knitting head in order to drive the knitting needles, several striping bars (7) which are parallel to the knitting head and on each of which a thread guide (6, 6*a*) is mounted slideably between two stop blocks (9, 9*a*) having sloped inner end portions and likewise movable along the striping bar, the thread guides equipped with a thread catcher (21, 21*a*) being driven by fingers (25, 25*a*) fixed to the carriage and mounted elastically so that they can be moved away from the thread guides by means of sloped inner end portions of the stop blocks, a mechanism (22, 29) for attaching the thread guides automatically to the stop blocks, individual auxiliary drive means (11, 13) for the stop blocks (9, 9*a*), and control means (12) intended for these drive means and subject to the control means of the knitting machine, said knitting machine possessing means of detaching the thread guides automatically from the stop blocks at the moment preceding the driving of the thread guides, and the control means (12) of the drive means (11) for the stop blocks enabling the stop blocks to be moved, together with the thread guides, at any moment during the movement of the carriage.

2. The knitting machine as claimed in claim 1, wherein the control means (12) and drive means (11, 13) for the stop blocks enable the thread guides to be moved and positioned on either side of the connecting point between two knitting zones during the shift of the carriage to this connecting point, in the interval separating the passage of two knitting systems.

3. The knitting machine as claimed in claim 1 or 2, wherein the attachment mechanism is composed of two pawls (22, 22*a*) mounted pivotably on the thread guide at an intermediate point and subjected to the action of a spring (23, 23*a*), these pawls each having an arm located in the path of the drive finger (25) so that the said drive finger releases the thread guide from the stop block, to which it is attached, at the moment preceding the driving of the thread guide.

* * * * *